US011749188B2

(12) United States Patent
Yamasaki et al.

(10) Patent No.: US 11,749,188 B2
(45) **Date of Patent: *Sep. 5, 2023**

(54) DISPLAY ELEMENT, DISPLAY APPARATUS, AND IMAGE PICKUP APPARATUS

(71) Applicant: CANON KABUSHIKI KAISHA, Tokyo (JP)

(72) Inventors: Takahiro Yamasaki, Tachikawa (JP); Yu Maehashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

This patent is subject to a terminal disclaimer.

(21) Appl. No.: 17/196,464

(22) Filed: Mar. 9, 2021

(65) Prior Publication Data

US 2021/0193032 A1 Jun. 24, 2021

Related U.S. Application Data

(63) Continuation of application No. 16/659,409, filed on Oct. 21, 2019, now Pat. No. 10,977,989.

(30) Foreign Application Priority Data

Oct. 22, 2018 (JP) ..... 2018-198701

(51) Int. Cl.
*G09G 3/3225* (2016.01)

(52) U.S. Cl.
CPC ... *G09G 3/3225* (2013.01); *G09G 2300/0828* (2013.01); *G09G 2310/0297* (2013.01); *G09G 2310/08* (2013.01)

(58) Field of Classification Search
CPC .. G09G 3/3275; G09G 3/2092; G09G 3/3688; G09G 3/3685; G09G 3/3283; G09G 3/3291; G09G 2310/027; G09G 2310/0297; G09G 2320/0209; G09G 3/3648; G09G 3/3225; G09G 2310/0275; G09G 2310/0272; G09G 2300/0828
See application file for complete search history.

(56) References Cited

U.S. PATENT DOCUMENTS 6,281,865 B1 * 8/2001 Koyama ..... G02F 1/1362 345/206
2016/0042695 A1 * 2/2016 Park ..... G09G 3/3648 345/690
2017/0372168 A1 * 12/2017 Kobayashi ..... H04N 9/07

FOREIGN PATENT DOCUMENTS

JP 2001-337657 A 12/2001
JP 2009-258237 A 11/2009
JP 2010-55041 A 3/2010

* cited by examiner

*Primary Examiner* — Xuemei Zheng
(74) *Attorney, Agent, or Firm* — Canon U.S.A., Inc. IP Division

(57) ABSTRACT

A display element includes a shield line disposed between adjacent ones of signal lines that transmit a digital signal from a latch unit to a plurality of digital-to-analog converters.

14 Claims, 15 Drawing Sheets

DISPLAY ELEMENT, DISPLAY APPARATUS, AND IMAGE PICKUP APPARATUS

CROSS-REFERENCE TO RELATED APPLICATION

This application is a Continuation of U.S. application Ser. No. 16/659,409, filed Oct. 21, 2019, which claims priority from Japanese Patent Application No. 2018-198701 filed Oct. 22, 2018, which are hereby incorporated by reference herein in their entireties.

BACKGROUND OF THE INVENTION

Field of the Invention

The aspect of the embodiments relates to a display element, a display apparatus, and an image pickup apparatus.

Description of the Related Art

Display elements are known, in which a plurality of pixels are configured to receive data sequentially input thereto from a column circuit. To provide a higher-resolution display apparatus, the circuit area of the column circuit is to be reduced.

In relation to techniques for reducing the circuit area of the column circuit, for example, Japanese Patent Laid-Open No. 2001-337657 discloses a display element. In the technique disclosed in Japanese Patent Laid-Open No. 2001-337657, every multiple ones of signal lines that transmit data to be output to pixels are driven in multiple batches. This allows multiple signal lines driven each time to share the same latch circuit and the same digital-to-analog converter (which may hereinafter be abbreviated as a DAC circuit), and thus can reduce the circuit area of the column circuit.

SUMMARY OF THE INVENTION

A display element according to an aspect of the embodiment includes a plurality of digital-to-analog converters; a scanning circuit configured to receive a digital signal input thereto and output the digital signal to each of the digital-to-analog converters; and a plurality of pixels arranged in a matrix and each configured to receive an analog signal from a corresponding one of the digital-to-analog converters, the analog signal being generated by digital-to-analog conversion of the digital signal performed by the digital-to-analog converter. In the display element, the scanning circuit includes a latch unit configured to hold the digital signal, a plurality of signal lines configured to transmit the digital signal from the latch unit to the digital-to-analog converters, and a shield line disposed between adjacent ones of the signal lines.

Further features of the disclosure will become apparent from the following description of exemplary embodiments with reference to the attached drawings.

DESCRIPTION OF THE EMBODIMENTS

Figure 1:
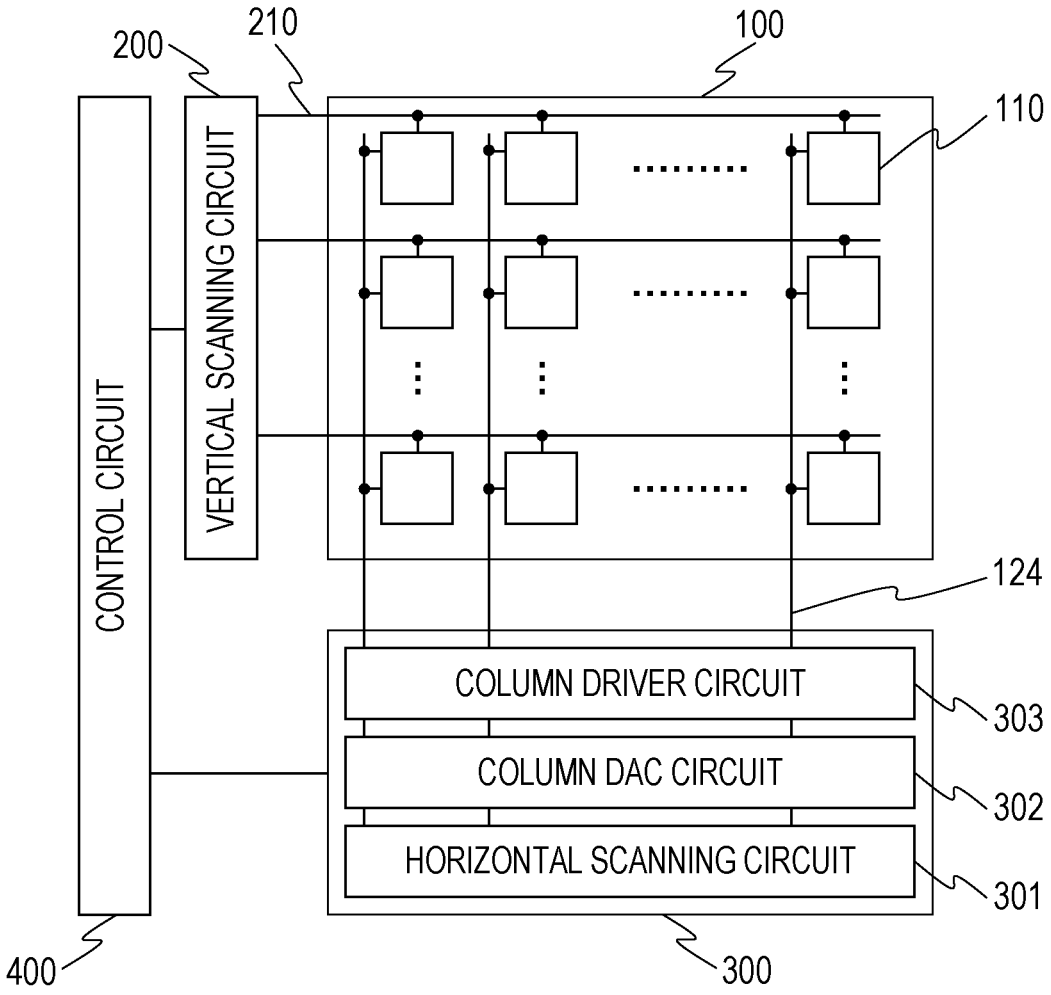
FIG. 1 illustrates a configuration of a display apparatus according to a first embodiment.

As technology advances, the circuit area of the column circuit decreases and resolution increases. Accordingly, the distance between adjacent signal lines for transmitting data from the latch circuit holding the data to the DAC circuit becomes narrower. The resulting parasitic capacitance between adjacent signal lines leads to an increased occurrence of crosstalk, in which data in one signal line causes a change in the signal level of data in the other signal line. As a result, an originally intended image may be displayed with errors (e.g., brightness deviations, color deviations, or defects). The embodiments described below relate to a technique that enables display of images with less errors.

Hereinafter, specific embodiments of a display apparatus according to the disclosure will be described with reference to the attached drawings. In the following description and drawings, components that are common among different drawings are denoted by the same reference numerals. The common components are described by cross-reference to multiple drawings, and the description of components denoted by the same reference numerals may be omitted where appropriate.

First Embodiment

A configuration of a display apparatus and a method for driving the display apparatus, according to an embodiment of the disclosure, will now be described with reference to the drawings. FIG. 1 is a general conceptual diagram illustrating an exemplary configuration of a display apparatus according to an embodiment of the disclosure. The display apparatus illustrated here is used as an organic light emitting display that includes an organic light emitting element. The organic light emitting element typically employs an organic electroluminescence (EL) layer, which is made of an organic light emitting material, as a light emitting layer. The present embodiment is not limited to the organic light emitting display, and may be, for example, a liquid crystal display.

The display apparatus includes a pixel array 100, which is a display area, a vertical scanning circuit 200, a signal output circuit 300, and a control circuit 400. The pixel array 100 includes a matrix of pixels (which may also be called sub-pixels) emitting light of three different colors, red (R), green (G), and blue (B), and the sub-pixels of the three colors are combined to represent the color and brightness of each pixel in an image. Each of the pixels (sub-pixels) includes an organic light emitting element that emits light of a corresponding one of the colors, red (R), green (G), and blue (B), and the organic light emitting element is provided with a driving circuit that drives the organic light emitting element. The organic light emitting element in each pixel may directly emit light of the corresponding one of the colors, red (R), green (G), and blue (B), or an organic light emitting element that emits light of a white color may be combined with a color filter of a given color to display the color. The present embodiment deals with an example where pixels of red (R), green (G), and blue (B) are arranged, but the configuration is not limited to this. For example, in the case of a display apparatus that displays only monochrome images, a pixel including an organic light emitting element of one color may form each pixel in an image. The signal output circuit 300 is a circuit that outputs a signal of visual data, such as luminance information, to each pixel. The vertical scanning circuit 200 is a circuit that outputs a signal for controlling the driving circuit of each pixel. The control circuit 400 is a circuit that controls, for example, the drive timing. The control circuit 400 is connected by wires to the signal output circuit 300 and the vertical scanning circuit 200.

The vertical scanning circuit 200 is connected to pixels 110 by scanning line groups 210, each of which includes a plurality of scanning lines.

The signal output circuit 300 includes a horizontal scanning circuit 301, a column DAC circuit 302 corresponding to a plurality of digital-to-analog converters, and a column driver circuit 303. The column DAC circuit 302 includes a plurality of DAC circuits, each corresponding to one column of the pixels 110. Each DAC circuit may be provided for a plurality of columns of the pixels 110. The column driver circuit 303 includes a plurality of driver circuits, each corresponding to one column of the pixels 110. Each driver circuit may be provided for a plurality of columns of the pixels 110.

The horizontal scanning circuit 301 scans the column DAC circuit 302 and inputs a digital signal received from the control circuit 400 to each of the DAC circuits of the column DAC circuit 302. The DAC circuit converts the received digital signal to a corresponding analog signal (potential).

Each driver circuit of the column driver circuit 303 outputs an analog signal received from a corresponding one of the DAC circuits to a corresponding signal line 124.

Figure 2:
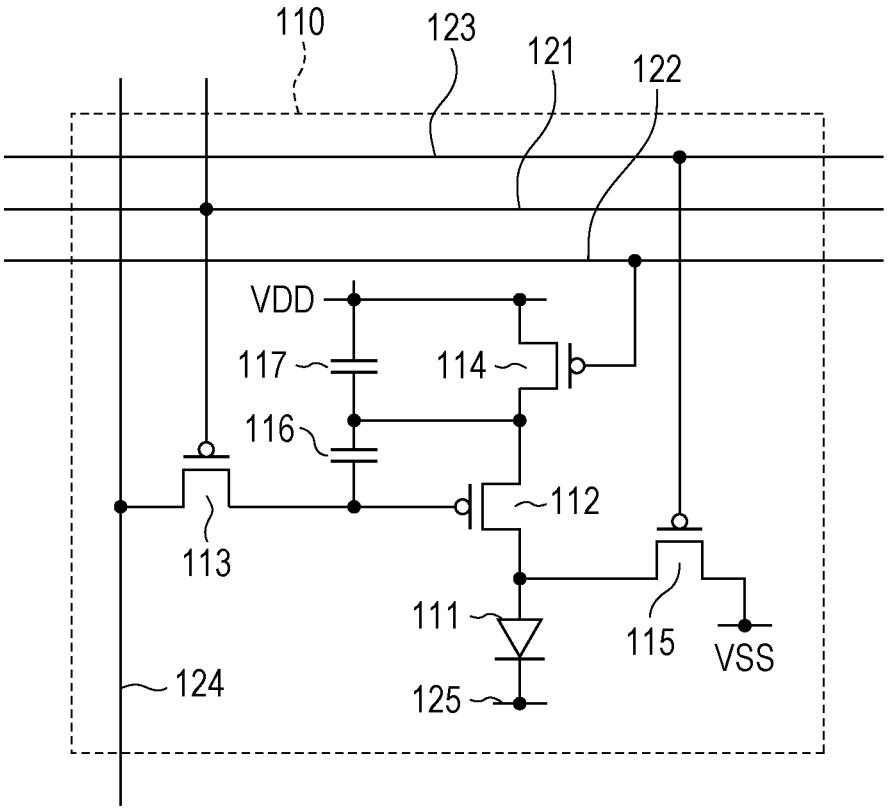
FIG. 2 illustrates a configuration of a pixel according to the first embodiment.

The pixels 110 used in the display apparatus of the present embodiment will now be described. As described above, the pixels 110 for emitting light of different colors, red (R), green (G), and blue (B), are arranged. For the purpose of explanation, FIG. 2 shows only one pixel 110 that includes a driving circuit for driving an organic light emitting element 111 of one of the three colors. Specifically, in the configuration illustrated in FIG. 2, the pixel 110 includes the organic light emitting element 111 of a current-driven type that changes its emission luminance in accordance with current flowing therein, and also includes the driving circuit that drives the organic light emitting element 111. The organic light emitting element 111 is connected at the cathode thereof to a common power supply 125 common to the organic light emitting elements 111 of all the pixels 110 of the pixel array 100.

The driving circuit for driving the organic light emitting element 111 includes a driving transistor 112, a selection transistor 113, switching transistors 114 and 115, and capacitive elements 116 and 117. The driving transistor 112, the selection transistor 113, and the switching transistors 114 and 115 used in the present embodiment are p-channel transistors (or p-channel metal oxide semiconductor (PMOS) transistors).

The driving transistor 112 is connected in series to the anode of the organic light emitting element 111 to supply driving current to the organic light emitting element 111. Specifically, the drain of the driving transistor 112 is connected to the anode of the organic light emitting element 111.

The selection transistor 113 is connected at the gate thereof to a scanning line 121, connected at the source thereof to the signal line 124, and connected at the drain thereof to the gate of the driving transistor 112. A signal from the vertical scanning circuit 200 is applied to the gate of the selection transistor 113 through the scanning line 121.

The switching transistor 114 is connected at the gate thereof to a scanning line 122, connected at the source thereof to a power supply potential VDD, and connected at the drain thereof to the source of the driving transistor 112. A signal from the vertical scanning circuit 200 for controlling the emission of the organic light emitting element 111 is applied to the gate of the switching transistor 114 through the scanning line 122. The switching transistor 115 is connected at the gate thereof to a scanning line 123, connected at the source thereof to a power supply potential VSS, and connected at the drain thereof to the anode of the organic light emitting element 111. A signal from the vertical scanning circuit 200 for controlling the potential of the anode of the organic light emitting element 111 is applied to the gate of the switching transistor 115 through the scanning line 123.

The capacitive element 116 is connected between the gate and the source of the driving transistor 112. The capacitive element 117 is connected between the source of the driving transistor 112 and the power supply potential VDD.

Although PMOS transistors are used as the transistors in the configuration illustrated in FIG. 2, the configuration is not limited to this and n-channel transistors (or n-channel metal oxide semiconductor (NMOS) transistors) may be used instead. Also, the circuit configuration of the driving circuit is not limited to a so-called 4Tr2C configuration including four transistors and two capacitive elements, such as that illustrated in FIG. 2. The transistors used here may be those formed on a silicon wafer, or may be thin-film transistors formed on a semiconductor film deposited on a glass substrate.

In the pixel 110, the selection transistor 113 is brought into conduction in response to a write signal applied to the gate of the selection transistor 113 from the vertical scanning circuit 200 through the scanning line 121. By this action, an image signal or reference potential corresponding to luminance information is sampled from the signal line 124.

Sampling the reference potential from the signal line 124 makes it possible to correct variation in the threshold potential of the driving transistor 112 among the pixels 110, and to reduce variation in luminance among the pixels 110 caused by the variation in threshold potential. The image signal or reference potential is applied to the gate of the driving transistor 112 and is, at the same time, held in the capacitive element 116.

The driving transistor 112 receives current supplied thereto from the power supply potential VDD through the switching transistor 114, and applies the current to the organic light emitting element 111 to cause it to emit light. The amount of current flowing in the organic light emitting element 111 is determined in accordance with the potential held in the capacitive element 116. The amount of light emitted by the organic light emitting element 111 can thus be controlled. The switching transistor 114 is brought into conduction when a signal for controlling light emission is applied from the vertical scanning circuit 200 through the scanning line 122 to the gate of the switching transistor 114. That is, the switching transistor 114 has the function of controlling the emission and non-emission of the organic light emitting element 111.

The switching transistor 115 selectively supplies the power supply potential VSS to the anode of the organic light emitting element 111 when a signal for controlling the potential of the anode of the organic light emitting element 111 is applied from the vertical scanning circuit 200 through the scanning line 123 to the gate of the switching transistor 115.

Figure 3:
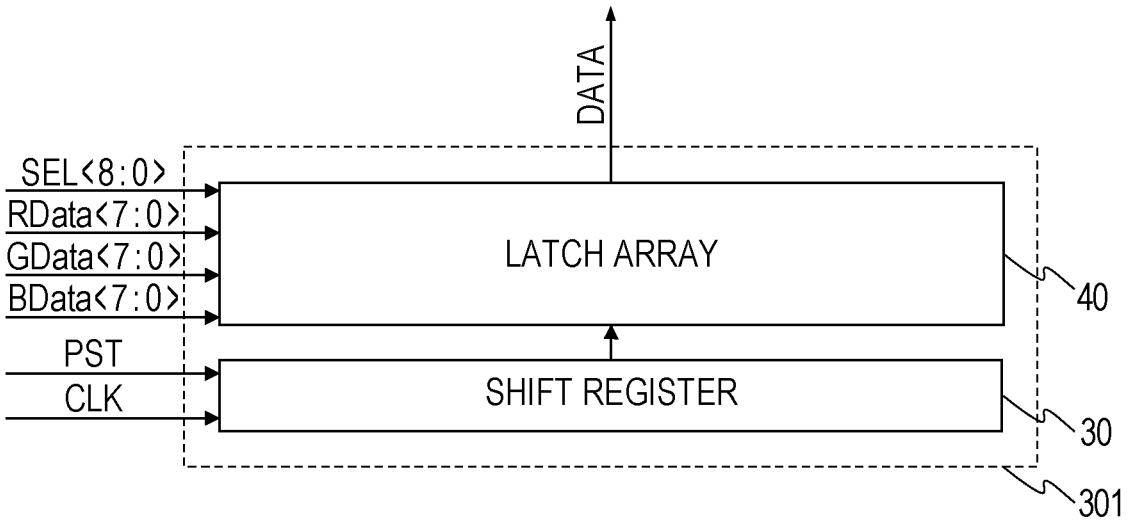
FIG. 3 illustrates a configuration of a horizontal scanning circuit according to the first embodiment.

FIG. 3 is a block diagram illustrating a configuration of the horizontal scanning circuit 301. The horizontal scanning circuit 301 includes a shift register 30 and a latch array 40, which is a latch unit. The shift register 30 receives a clock signal CLK input thereto. The latch array 40 receives data RData, GData, and BData as eight-bit digital signals input thereto from the control circuit 400 illustrated in FIG. 1. The RData, GData, and BData are digital data, each representing luminance information of one pixel 110. The latch array 40 includes a plurality of latches, as described below. Data is written to each of the latches in accordance with the timing of an output pulse from the shift register 30.

Figure 4:
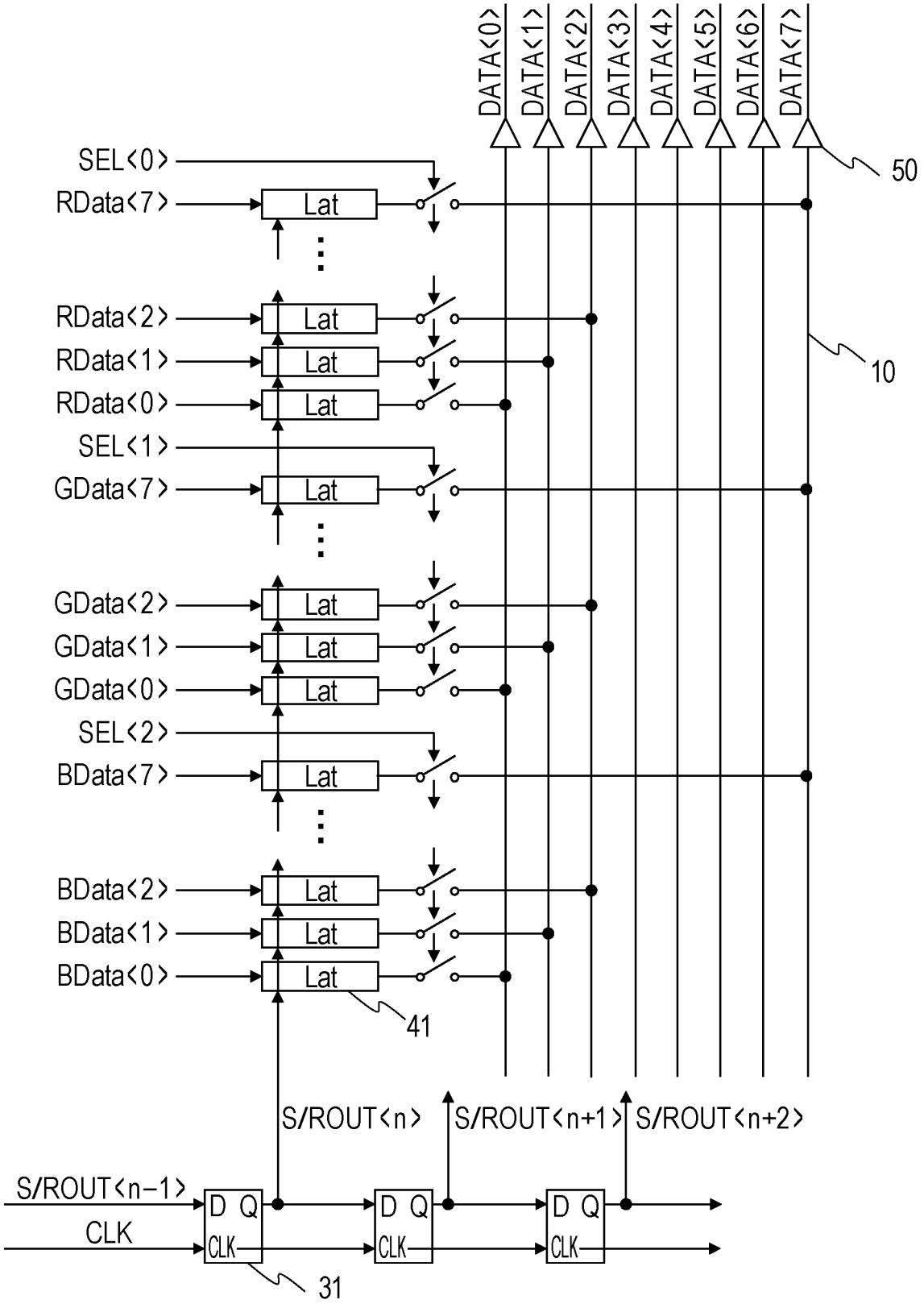
FIG. 4 illustrates a detailed configuration of the horizontal scanning circuit illustrated in FIG. 3.

FIG. 4 illustrates details of the circuit of the shift register 30 and the latch array 40 illustrated in FIG. 3. Specifically, FIG. 4 illustrates part of the circuit of each of the shift register 30 and the latch array 40 related to processing of one piece of RData, one piece of GData, and one piece of BData. The display apparatus used in practice includes a plurality of circuits, each illustrated in FIG. 4, depending on the number of columns of the pixels 110 illustrated in FIG. 1. The shift register 30 includes a plurality of flip-flops 31 connected in series. The latch array 40 includes a plurality of latches 41, as described above.

The latches 41, to which respective pieces of data are written, are sequentially selected by an output signal S/ROUT<A> (where A is a natural number) from a corresponding one of the flip-flops 31. Referring to FIG. 4, the output signal S/ROUT<n> is output to corresponding ones of the latches 41. The latches 41 each hold a one-bit digital signal.

Each latch 41 is connected through a corresponding switch to a signal line 10. Data of the latch 41 output to the signal line 10 is output through a buffer 50 to a corresponding one of the DAC circuits of the column DAC circuit 302.

By a signal SEL<B> (where B is one of the natural numbers 0 to 2 in FIG. 4) output from the control circuit 400, data to be output to the signal line 10 is selected from RData, GData, and BData. For example, when the signal SEL<0> becomes active, RData<0> to RData<7> are output through the corresponding signal lines 10 and buffers 50 to the corresponding DAC circuits. Likewise, when the signal SEL<1> becomes active, GData<0> to GData<7> are output to the corresponding DAC circuits. Also, when the signal SEL<2> becomes active, BData<0> to BData<7> are output to the corresponding DAC circuits.

The operation of the circuit illustrated in FIG. 4 will now be described using the timing chart of FIG. 5. Of the flip-flops 31 included in the shift register 30, the flip-flop 31 for the first column (not shown in FIG. 4) receives a signal PST input thereto. From the flip-flop 31 to which the signal PST has been input, the signal S/ROUT<0> synchronized with the rising edge of the input clock signal CLK is output to corresponding ones of the latches 41 and also to the flip-flop 31 on the subsequent stage. The values of RData, GData, and BData, at the falling edge of the output signal S/ROUT of the flip-flop 31, are each held by the latch 41 corresponding to each bit of the data. When the output signal S/ROUT of the flip-flop 31 for the last column (or the 1043rd column in the present embodiment) is output, the latch array 40 completes the holding of data for one predetermined row of the pixel array 100. Then, when the signal SEL<0> becomes active, RData for one pixel in each column are simultaneously output through the signal lines 10 and the buffers 50 to the DAC circuits corresponding to the latches 41. Likewise, the control circuit 400 sequentially activates the signal SEL<1> and the signal SEL<2>. This causes RData, GData, and BData to be output to the column DAC circuit 302. When the output of RGB data of three pixels for R, G, and B is complete, the scanning of the pixels 110 in one row is complete. Note that RData, GData, and BData may be output in an order different from that described above.

Figure 6:
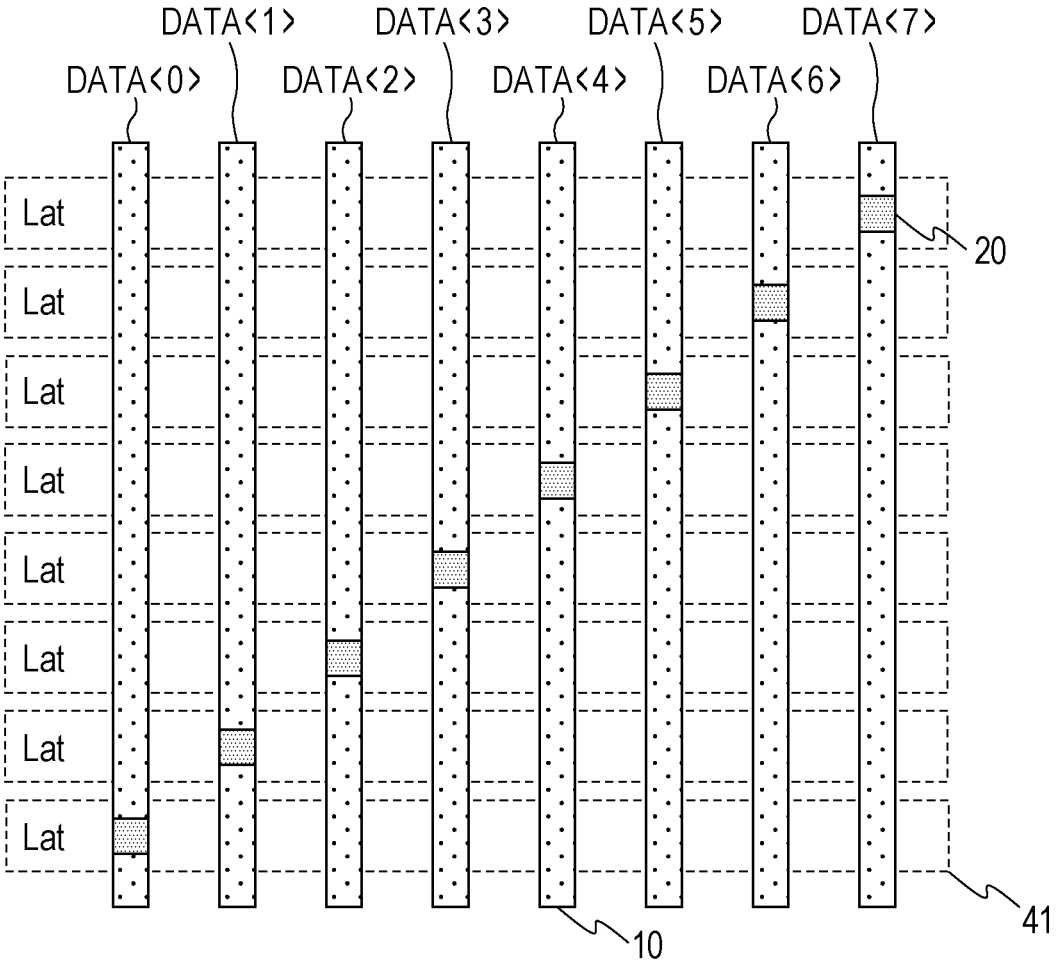
FIG. 6 illustrates a planar layout of signal lines and latches according to the first embodiment.

FIG. 6 illustrates a planar layout of the signal lines 10 and the latches 41 (i.e., a layout as viewed from above the display apparatus). The layout shown here is for eight bits of Data corresponding to one color.

Each signal line 10 is connected by a via 20 to one latch 41. Data held by the latch 41 is output through the via 20 to the signal line 10.

As illustrated in FIG. 4, the signal lines 10 that transmit signals for different bits are arranged adjacent to each other. This causes parasitic capacitance between adjacent ones of the signal lines 10. The parasitic capacitance leads to an increased occurrence of so-called crosstalk in which a change in the signal level of one signal line 10 changes the potential of the other signal line 10.

Figure 5:
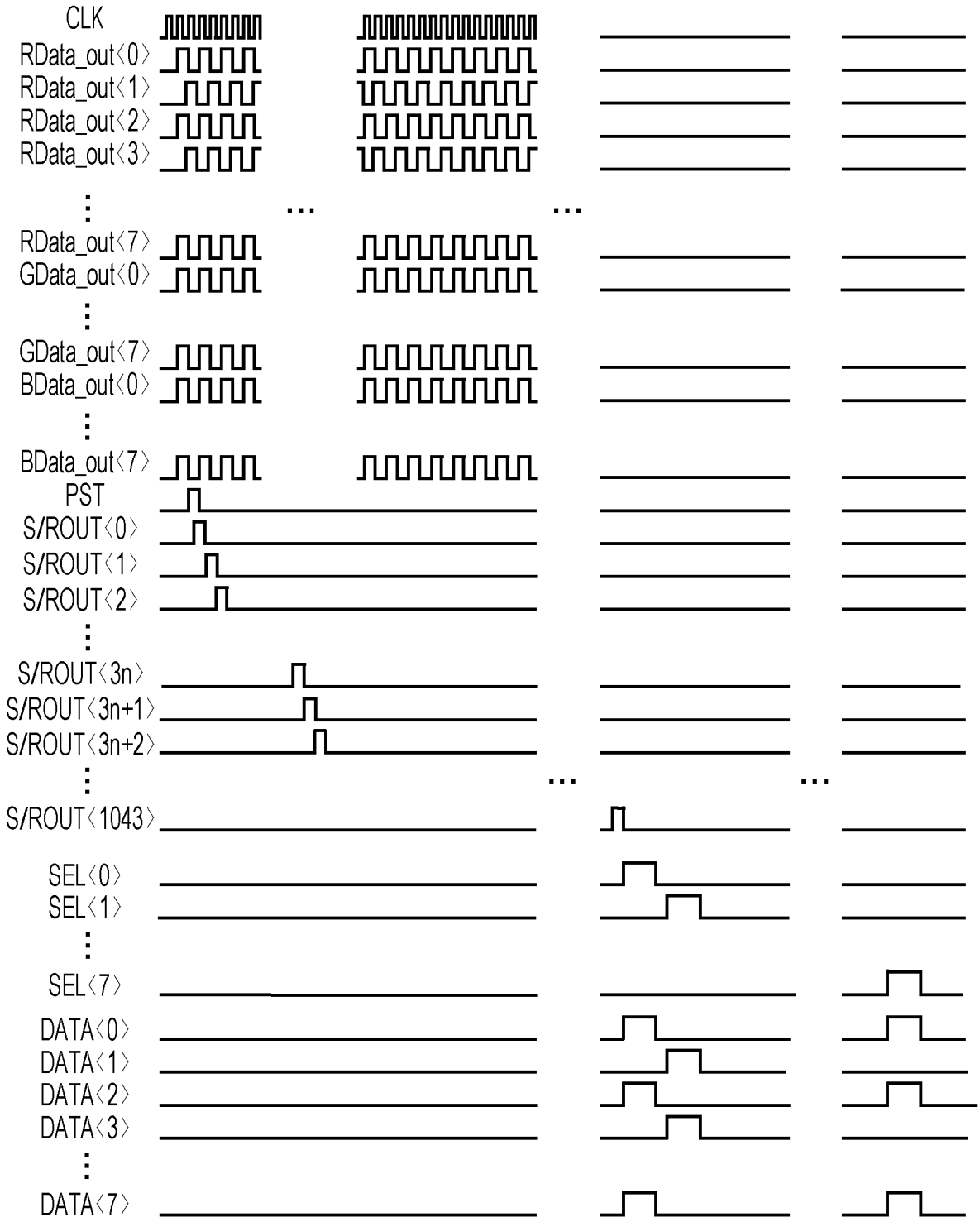
FIG. 5 illustrates an operation of the horizontal scanning circuit illustrated in FIG. 4.

Referring to FIG. 5, for example, the signal potential of DATA<1> is output in a phase opposite that of DATA<0> and DATA<2>. In this case, the parasitic capacitance between the signal line 10 for transmitting DATA<1> and the signal line 10 for transmitting DATA<0>, and the parasitic capacitance between the signal line 10 for transmitting DATA<1> and the signal line 10 for transmitting DATA<2>, are both larger than that in the case of output in the same phase.

As a result, the signal level of DATA<0> and DATA<2> is changed by a change in the signal level of DATA<1>, or the signal level of DATA<1> is changed by a change in the signal level of DATA<0> and DATA<2>.

For example, assume that DATA<1> changes from the power supply potential level (which is High level or may hereinafter be referred to as Hi level) to GND level (which is Low level or may hereinafter be referred to as Lo level), whereas DATA<0> and DATA<2> change from Lo level to Hi level. In this case, if, in the signal line 10 for DATA<1>, the signal level does not fall below the logical threshold of the buffer 50 at the end of the select period by the signal SEL, DATA<1> stays at Hi level, instead of changing to the originally intended Lo level. As a result, the value of data different from that of the original digital image data is output to the pixels. This degrades the quality of an image displayed by the display apparatus (e.g., at least brightness or color differs from that of the original image).

As the latches 41 have been lowered in power supply potential and have become finer particularly in recent years, the driving capability of the latches 41 is decreasing and yet the refresh rate of the display apparatus is increasing. This worsens the issue of degradation of the quality of the displayed image caused by crosstalk between the signal lines 10.

Figure 7:
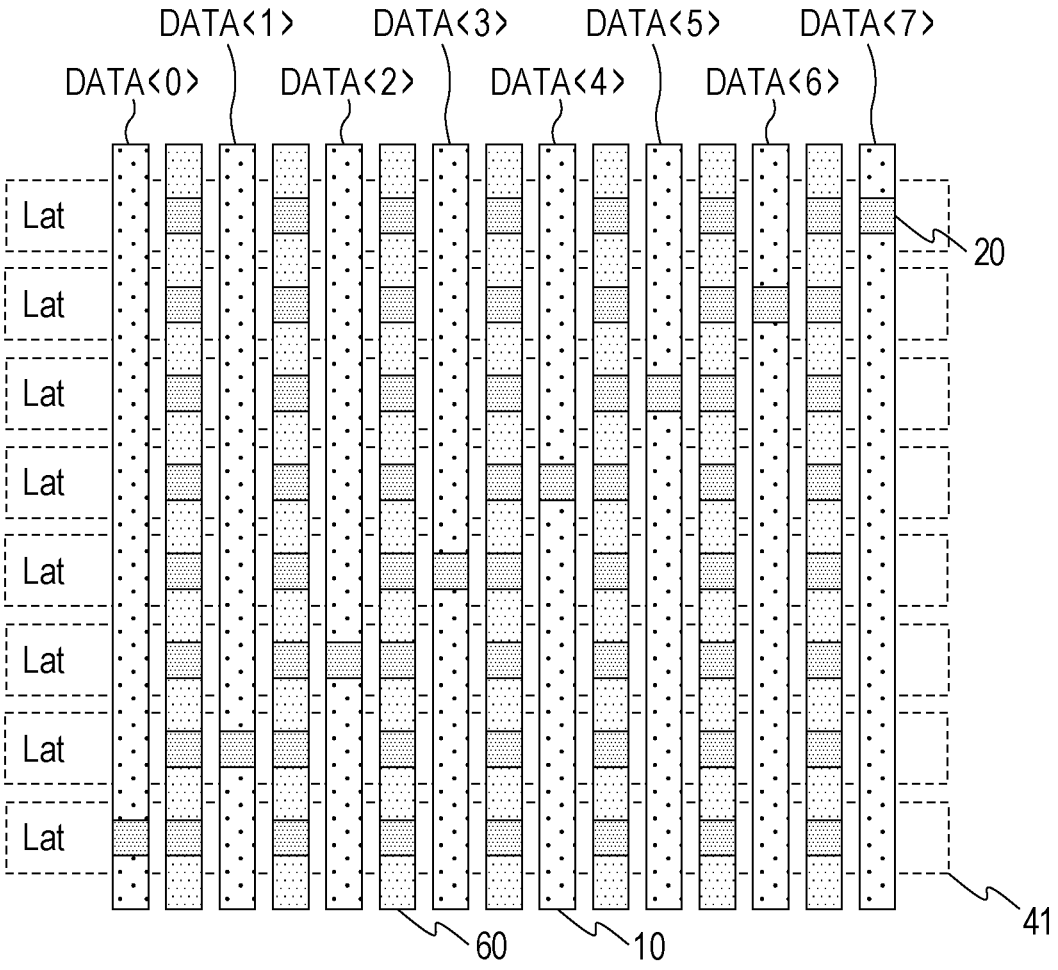
FIG. 7 illustrates a planar layout of the signal lines and shield lines according to the first embodiment.

FIG. 7 illustrates a planar layout of the signal lines 10 (i.e., a layout as viewed from above the display apparatus) according to the present embodiment.

In the arrangement illustrated in FIG. 7, shield lines 60 are each provided between adjacent ones of the signal lines 10. This can reduce parasitic capacitance between the signal lines 10, and thus can reduce the occurrence of crosstalk between the signal lines 10. Since changes in the signal level of the signal lines 10 caused by crosstalk can be reduced, it is possible to reduce degradation of the quality of the displayed image.

As a predetermined potential, a ground potential (GND potential) is typically given to the shield lines 60 illustrated in FIG. 7. This means that over the period from the start to the end of transmission of a digital signal through the signal lines 10, a predetermined potential is given to the shield lines 60.

The potential given to the shield lines 60 is not limited to this example, and another fixed potential (e.g., positive power supply potential) may be given. The potential of the shield lines 60 may be varied. For example, the shield lines 60 may be signal lines that are provided with a signal that varies at times different from times when the signal levels in the signal lines 10 change. For example, the shield lines 60 may be wires that transmit signals output by the flip-flops 31.

Figure 8:
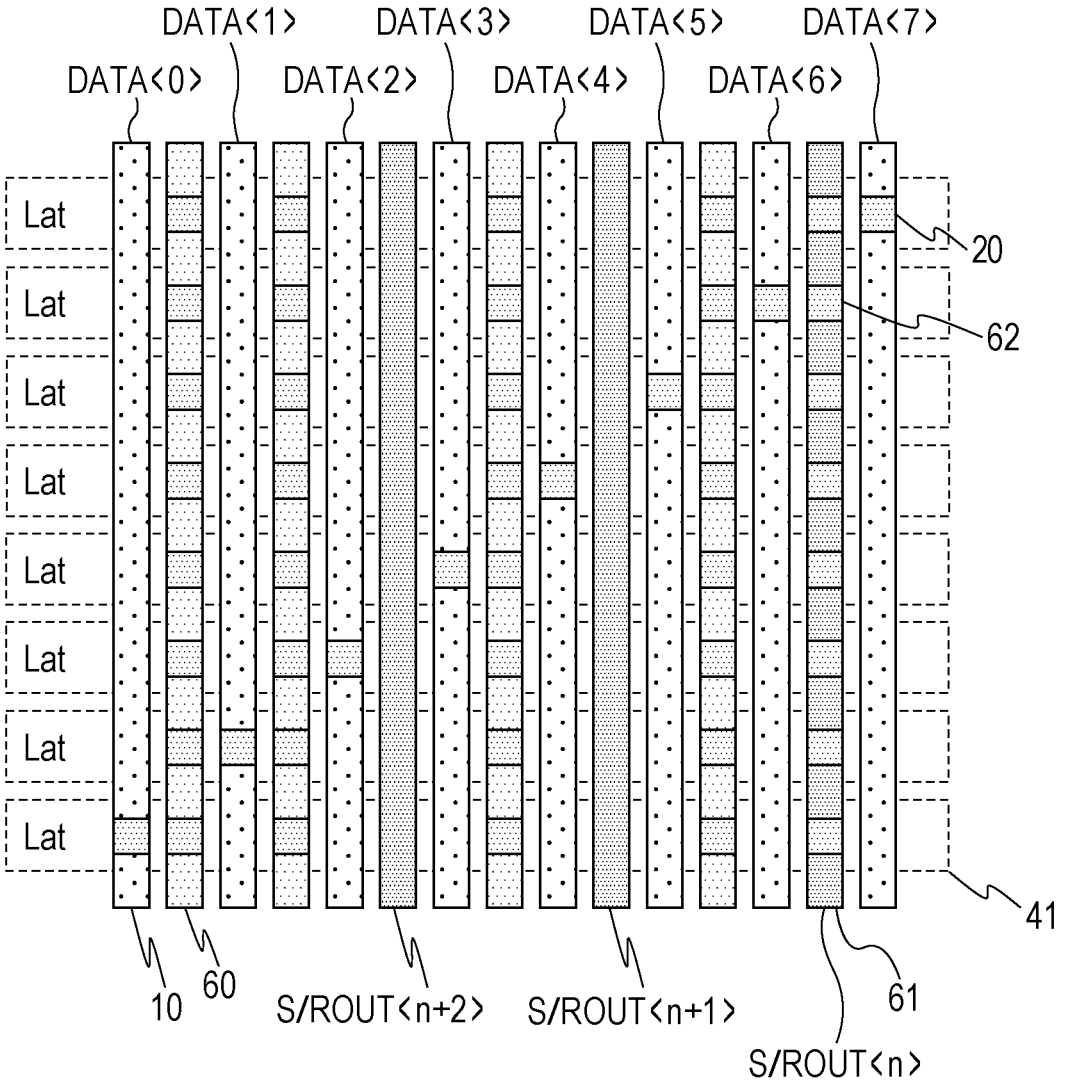
FIG. 8 illustrates a planar layout of the signal lines and the shield lines according to the first embodiment.

FIG. 8 illustrates a layout of shield lines in such a case. As illustrated, signal lines 61 for transmitting the signals S/ROUT output from the flip-flops 31 are each provided as a shield line between adjacent ones of the signal lines 10. In the example of FIG. 8, the shield lines 60 to which a fixed potential (typically GND potential) is given are also provided, each between adjacent ones of the signal lines 10. Wires to which a fixed potential is given in this manner, and signal lines that change in potential at times different from times when the potentials of the signal lines 10 change, may each be provided between adjacent ones of the signal lines 10.

The latches 41 illustrated in FIG. 8 receive signals S/ROUT input thereto. The latches 41 are thus connected by vias 62 to the signal lines 61 that transmit the signals S/ROUT.

Figure 9:
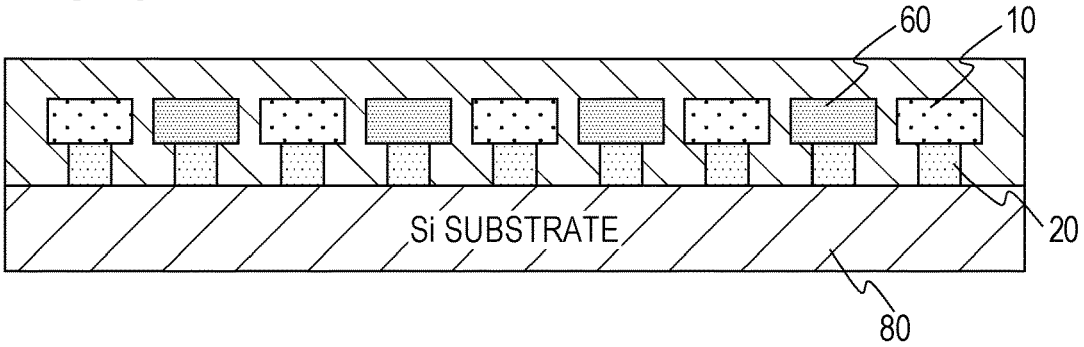
FIG. 9 illustrates a cross-sectional layout of the signal lines and the shield lines illustrated in FIG. 7.

FIG. 9 illustrates a cross-sectional layout of the shield lines 60 and the signal lines 10 illustrated in FIG. 7. The signal lines 10 are arranged over a silicon (Si) substrate 80 (on the display side), and the shield lines 60 are arranged in a wiring layer where the signal lines 10 are arranged.

In this example, the signal lines 10 and the shield lines 60 are arranged in the same wiring layer.

Another example will now be described, in which some of the signal lines 10 are arranged in one wiring layer and others of the signal lines 10 are arranged in a different wiring layer.

Figure 10:
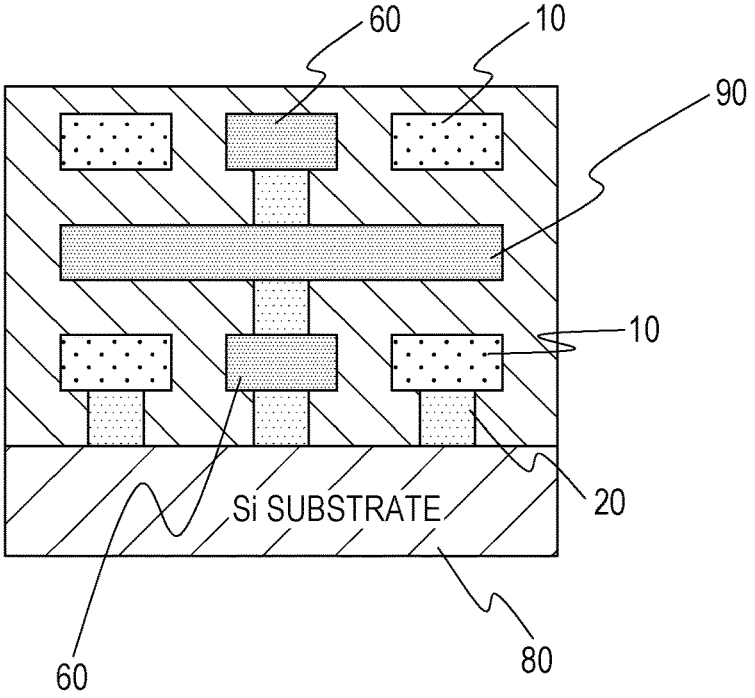
FIG. 10 illustrates another cross-sectional layout of the signal lines and the shield lines according to the first embodiment.

FIG. 10 illustrates another cross-sectional layout of the shield lines 60 and the signal lines 10. As illustrated, some of the signal lines 10 are arranged in a first layer, and others of the signal lines 10 are arranged in a second layer. Note that the first and second layers are different wiring layers.

The shield lines 60 are also arranged in different wiring layers, the first and second layers, each including the signal lines 10 as described above. The shield lines 60 in the different wiring layers are arranged, with a shield line 90 interposed therebetween, and are connected to each other by vias. The shield line 90 is in a third layer between the first and second layers. The shield line 90 is disposed to overlap, in plan view, the signal lines 10 arranged in the different wiring layers. This can reduce parasitic capacitance between adjacent ones of the signal lines 10 arranged in the different wiring layers.

As described above, the display apparatus of the present embodiment includes shield lines, each disposed between adjacent ones of the signal lines 10. This can reduce parasitic capacitance and crosstalk between adjacent ones of the signal lines 10. It is thus possible to prevent degradation of the quality of the displayed image caused by crosstalk.

Second Embodiment

The description of a second embodiment will focus primarily on differences between the first and second embodiments.

Figure 11:
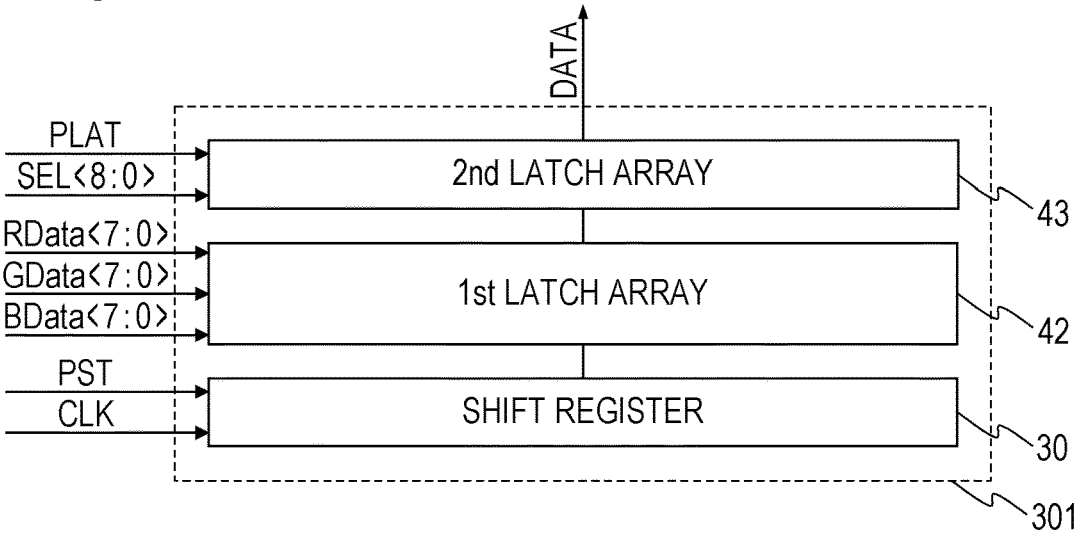
FIG. 11 illustrates a configuration of a horizontal scanning circuit according to a second embodiment.

FIG. 11 is a diagram illustrating the horizontal scanning circuit 301 according to the present embodiment. Unlike the horizontal scanning circuit 301 of the first embodiment, the horizontal scanning circuit 301 of the present embodiment includes a 1st latch array 42 (first latch array) and a 2nd latch array 43 (second latch array). The horizontal scanning circuit 301 of the present embodiment performs an output operation that outputs, to the column DAC circuit 302, digital data corresponding to a signal to be output to the pixels 110 in a given row. During the period of this output operation, the horizontal scanning circuit 301 can simultaneously perform the operation of receiving digital data corresponding to a signal output from the control circuit 400 and to be output to the pixels 110 in another row. This can shorten the length of time required to write the signal to all the pixels 110.

Figure 12:
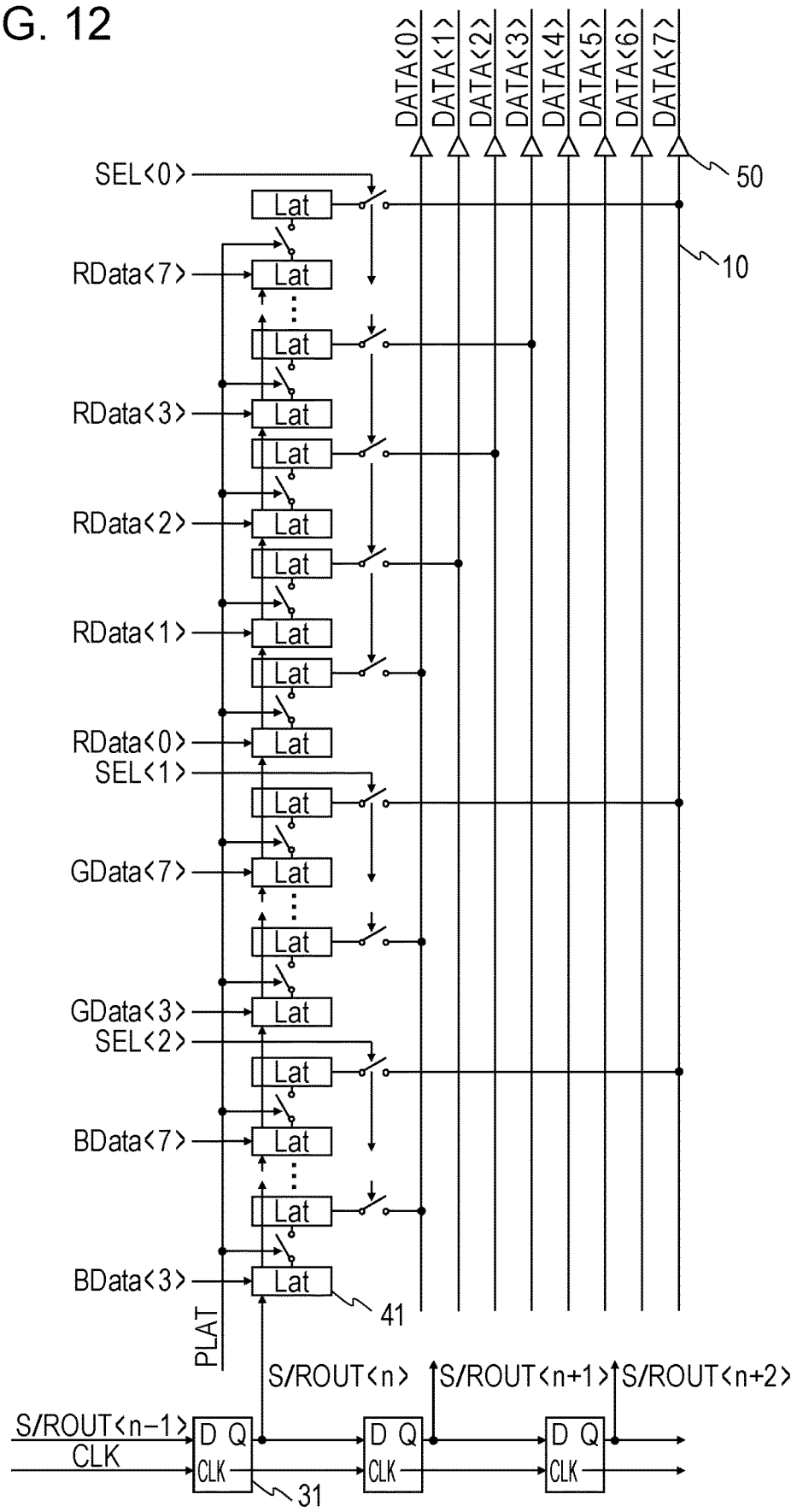
FIG. 12 illustrates a detailed configuration of the horizontal scanning circuit illustrated in FIG. 11.

FIG. 12 illustrates a column circuit corresponding to one column of pixels according to the present embodiment. Like the latch array 40 of the first embodiment, the 1st latch array 42 and the 2nd latch array 43 of the present embodiment both include the latches 41. In this case, a signal output from the 1st latch array 42 is input to the 2nd latch array 43. As a control signal for controlling the operation of holding data output from the 1st latch array 42, a signal PLAT is input from the control circuit 400 illustrated in FIG. 1.

Figure 13:
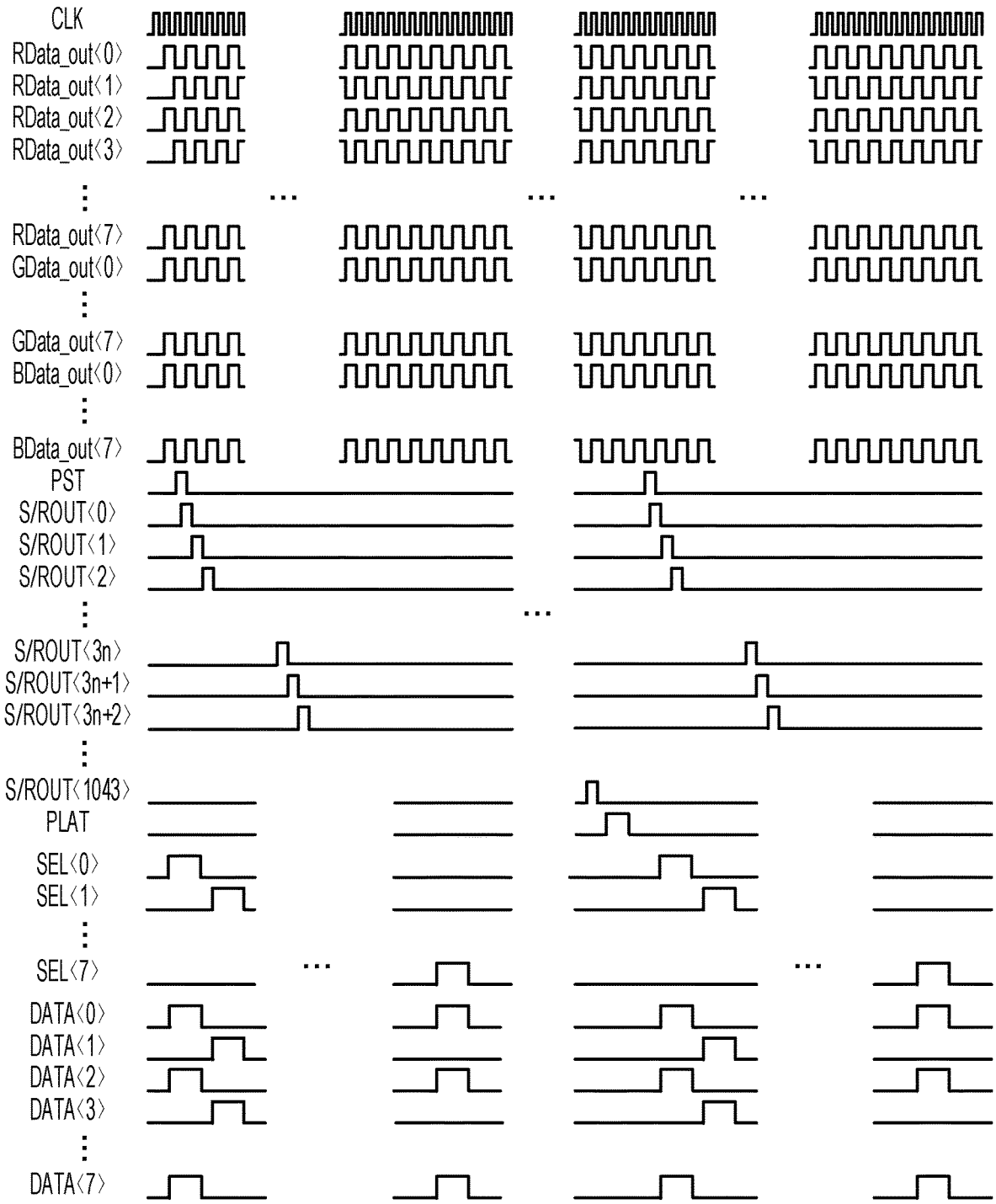
FIG. 13 illustrates an operation of the horizontal scanning circuit illustrated in FIG. 12.

The operation of the display apparatus according to the present embodiment will now be described using the timing chart of FIG. 13. Data is written to the 1st latch array 42 in the same manner as in the first embodiment.

After data is written to all columns of the 1st latch array 42, the control circuit 400 activates the signal PLAT. This causes data held by the 1st latch array 42 to be held by the 2nd latch array 43. Typically, the latches 41 of the 2nd latch array 43 are arranged to correspond to the respective latches 41 of the 1st latch array 42. When the signal PLAT becomes active, the latches 41 of the 2nd latch array 43 each hold data output by a corresponding one of the latches 41 of the 1st latch array 42. Typically, the latches 41 of the 2nd latch array 43 simultaneously hold the respective pieces of data of the corresponding latches 41 of the 1st latch array 42.

Then, the 2nd latch array 43 outputs the held data to the corresponding signal lines 10. In the present embodiment, the latches 41 that perform an input operation involving transmitting data from the control circuit 400 to the horizontal scanning circuit 301 are ones that differ from the latches 41 that perform an output operation involving transmitting data from the horizontal scanning circuit 301 to the column DAC circuit 302. This enables the input of data from the control circuit 400 to the horizontal scanning circuit 301 and the output of data from the horizontal scanning circuit 301 to the column DAC circuit 302 to be carried out in parallel.

The horizontal scanning circuit 301 of the present embodiment, which includes the 2nd latch array 43, has more circuit elements than the horizontal scanning circuit 301 of the first embodiment. In general, display apparatuses are limited in size. For example, in electronic viewfinders of cameras and displays of mobile terminals, the layout of the display apparatus is limited depending on the application and specification of the camera or mobile terminal. It is not easy to increase the circuit area of the horizontal scanning circuit 301. Therefore, the demand for the horizontal scanning circuit 301 with a finer pattern tends to be greater than that for the first embodiment. Accordingly, the distance between adjacent ones of the signal lines 10 tends to be narrower than that in the first embodiment. This means that the possibility of crosstalk between the signal lines 10 is higher than that in the first embodiment. As compared to the display apparatus of the first embodiment, it is more likely that crosstalk will degrade the quality of the displayed image. In the present embodiment, therefore, the beneficial effect of crosstalk reduction achieved by adding the shield lines 60 between the signal lines 10 in the configuration of the first embodiment (as illustrated in FIG. 7 or 8) is more significant than in the first embodiment.

Figure 14:
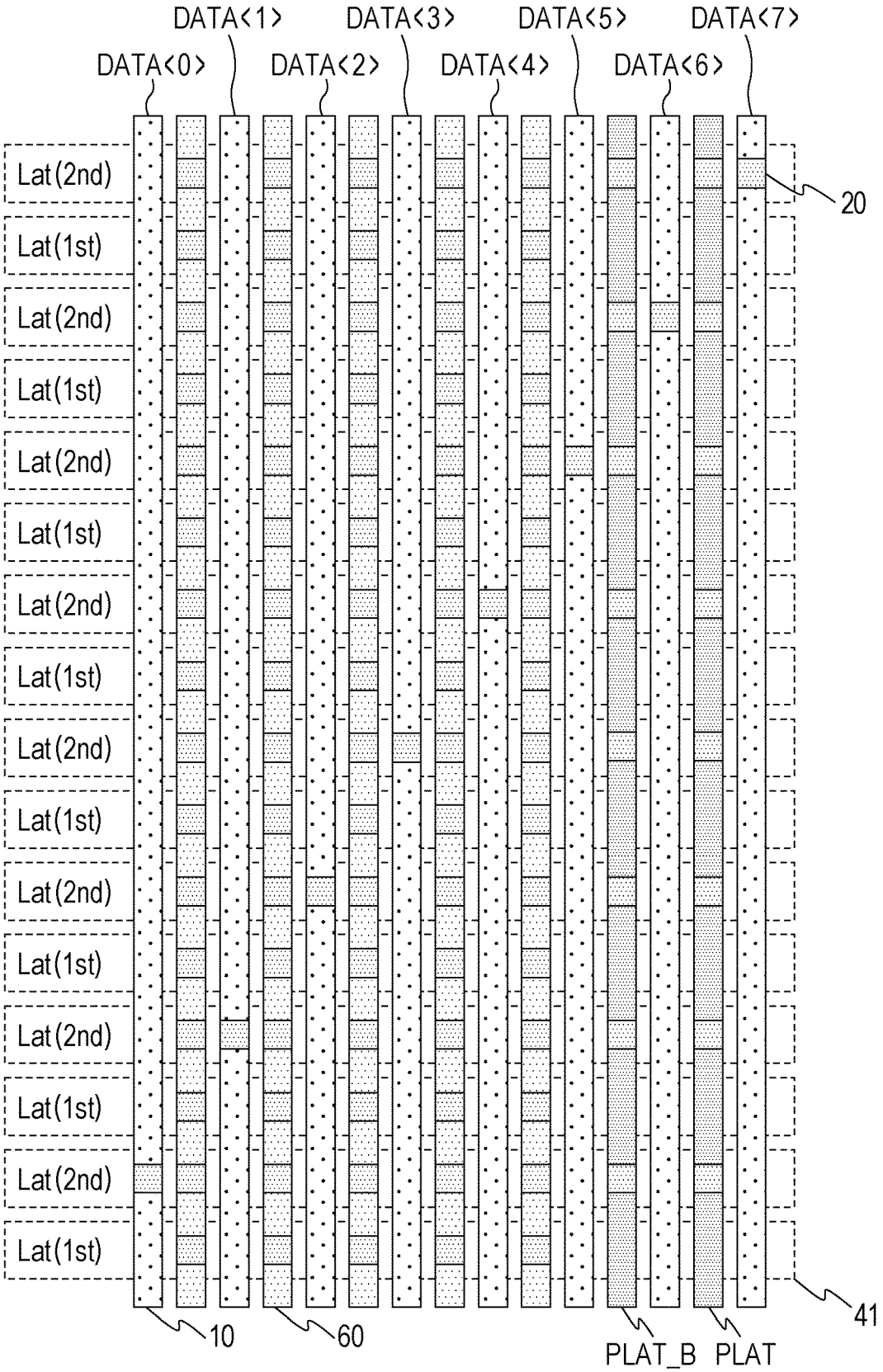
FIG. 14 illustrates a planar layout of signal lines and shield lines according to the second embodiment.

In the present embodiment, as described above, the input of data from the control circuit 400 to the horizontal scanning circuit 301 and the output of data from the horizontal scanning circuit 301 to the column DAC circuit 302 are carried out in parallel. Therefore, the signal level of the wires that transmit the outputs of the flip-flops 31 may change when the signal levels of the signal lines 10 change. On the other hand, during the period in which the 2nd latch array 43 outputs data to the column DAC circuit 302, the signal PLAT is non-active and constant. Therefore, when signal lines for transmitting a signal that changes at times different from times when the signal levels of the signal lines 10 change, are used as shield lines, the signal lines that transmit the signal PLAT may be used as shield lines, as illustrated in FIG. 14.

Figure 15:
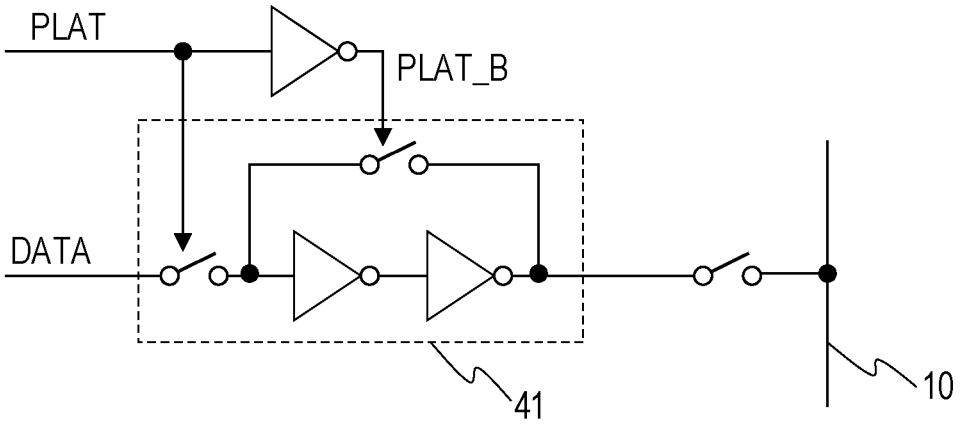
FIG. 15 illustrates a configuration of a latch according to the second embodiment.
Figure 16:
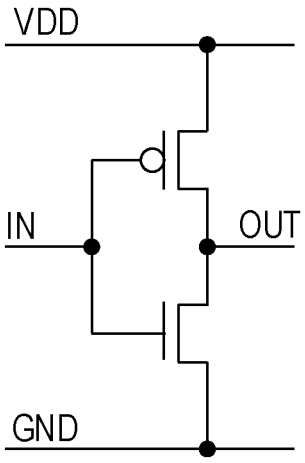
FIG. 16 illustrates a configuration of an inverter according to the second embodiment.

An example will now be described, in which the beneficial effect of the present embodiment is significant. As illustrated in FIG. 15, the latch 41 includes a buffer unit in which a plurality of inverters are connected in series. For example, the inverters in the latch 41 each include an NMOS transistor and a PMOS transistor, as illustrated in FIG. 16. Generally, when NMOS and PMOS transistors have the same gate width, the PMOS transistor has a lower drive capability than the NMOS transistor. This is because the hole mobility is smaller than the electron mobility. Therefore, when a signal is output to the signal line 10, it takes more time to raise the signal level from Lo level to Hi level than it does to lower the signal level from Hi level to Lo level. In the operation illustrated in FIG. 13, at the time when DATA<1> changes from Lo level to Hi level, DATA<0> and DATA<2> change from Hi level to Lo level. In this case, the potential of DATA<1>> is shifted to Lo level by the influence of crosstalk from DATA<0> and DATA<2>. In the configuration of the buffer unit of the latch 41 illustrated in FIG. 15, the signal line 10 is connected to an input and output feedback loop of the latch 41 connected to DATA<1>. Therefore, the signal to be held at Hi level is fed back by the influence of crosstalk to Lo level and when the signal PLAT becomes non-active, the corresponding data is held at Lo level in the latch 41. In the present embodiment, however, the shield lines 60 are each provided between adjacent ones of the signal lines 10. This can reduce the occurrence of crosstalk in which a signal change in one of adjacent signal lines 10 causes a signal change in the other signal line 10. It is thus possible to prevent data from being rewritten and reduce degradation of the quality of the displayed image.

As in the configuration of the first embodiment illustrated in FIG. 10, the shield lines 60 of the present embodiment may be arranged in multiple layers. This can reduce the occurrence of crosstalk, as in the case of the configuration of the first embodiment illustrated in FIG. 10.

Third Embodiment

A display apparatus according to the present embodiment may be used as a display unit for an image forming apparatus, such as a multifunction printer or an inkjet printer. In this case, the display apparatus may have both a display function and an operation function.

Figure 17:
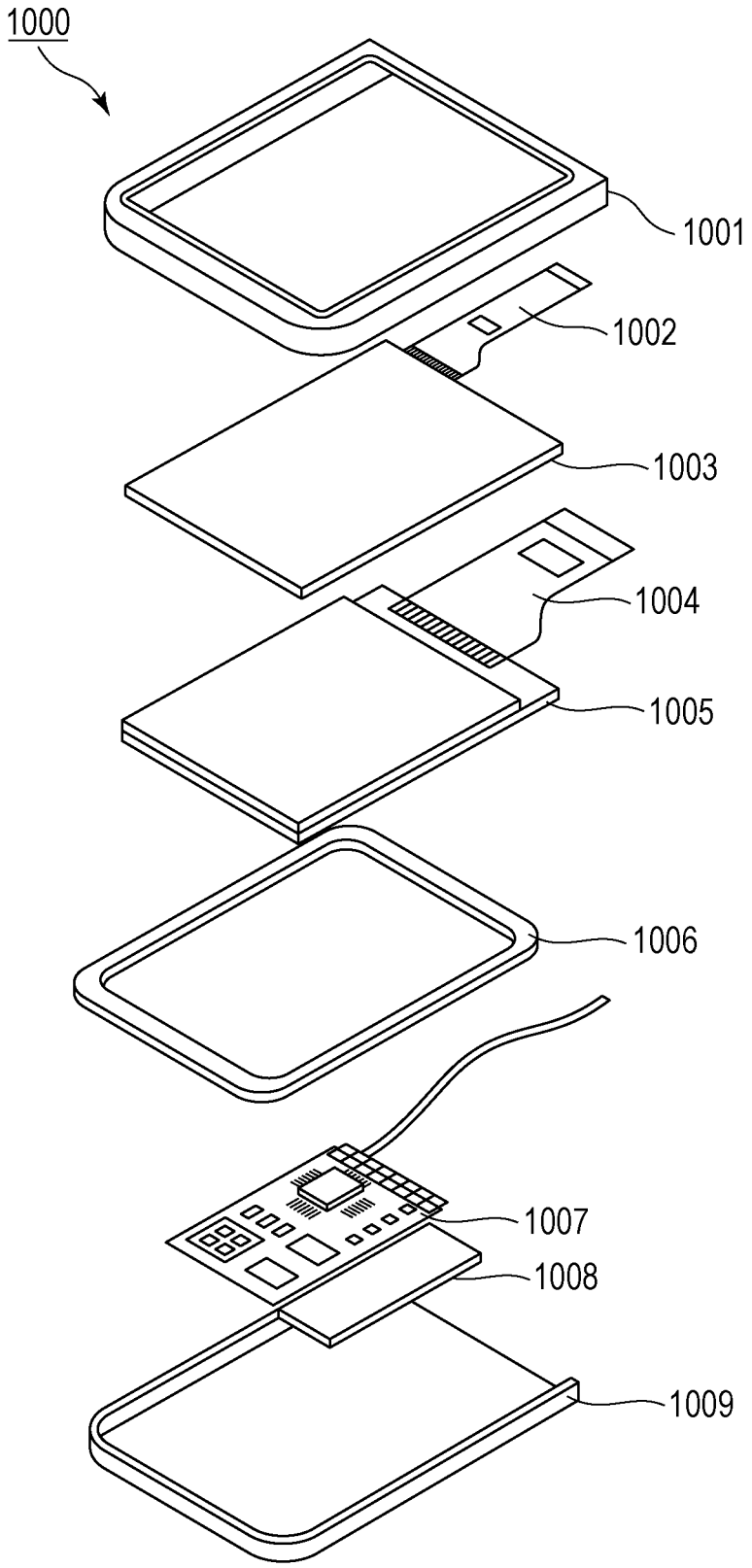
FIG. 17 illustrates a display apparatus according to a third embodiment.

FIG. 17 is a schematic diagram illustrating an example of the display apparatus according to the present embodiment. A display apparatus 1000 may include, between an upper cover 1001 and a lower cover 1009, a touch panel 1003, a display panel 1005, a frame 1006, a circuit board 1007, and a battery 1008. Flexible printed circuits (FPCs) 1002 and 1004 are connected to the touch panel 1003 and the display panel 1005, respectively. The display panel 1005 includes the display element according to any of the embodiments described above. A transistor is printed on the circuit board 1007. The display apparatus does not necessarily need to include the battery 1008 unless the display apparatus is a mobile device. Even when the display apparatus is a mobile device, the battery 1008 does not necessarily need to be positioned as illustrated in FIG. 17.

The display apparatus according to the present embodiment may be used as a display unit for an image pickup apparatus, such as a camera, which includes an optical system including a plurality of lenses, and an image pickup element configured to receive light passing through the optical system. The image pickup apparatus may include a display unit configured to display information acquired by the image pickup element. The display unit may be a display unit exposed to the outside of the image pickup apparatus, or may be a display unit disposed in a finder.

Figure 18:
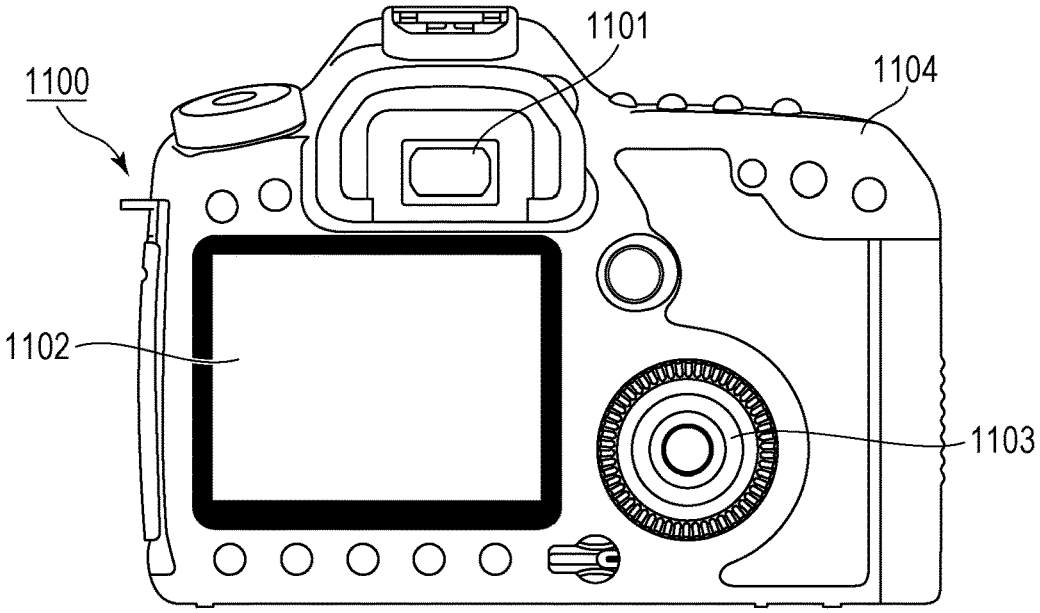
FIG. 18 illustrates an image pickup apparatus according to the third embodiment.

FIG. 18 is a schematic diagram of an image pickup apparatus according to the present embodiment. An image pickup apparatus 1100 may include a viewfinder 1101, a back-side display (or sub-display) 1102, an operation unit 1103, and a housing 1104. The viewfinder 1101 may include the display apparatus according to any of the embodiments described above. In this case, the display apparatus may display environmental information and image pickup instructions, as well as an image to be picked up. The environmental information may include, for example, the intensity of outside light, the orientation of outside light, the speed of subject's motion, and the possibility of obstruction to the subject being viewed.

Since the timing suitable for picking up an image is limited, it is better to display the information as quickly as possible. Therefore, the display apparatus including the organic EL element according to any of the embodiments described above is used. This is because the organic EL element offers a fast response speed. For faster display speed, the display apparatus including the organic EL element can be used more favorably than liquid crystal display apparatuses.

The image pickup apparatus 1100 includes an optical unit (not shown). The optical unit includes a plurality of lenses and forms an image onto an image pickup element housed in the housing 1104. The focus of the lenses can be adjusted by adjusting the relative position of the lenses. This operation may be done automatically.

The display apparatus of the present embodiment may include color filters of red, green, and blue. The color filters of red, green, and blue may be arranged in a delta pattern.

The display apparatus of the present embodiment may be used as a display unit for a mobile terminal. In this case, the display apparatus may have both a display function and an operation function. Examples of the mobile terminal include a mobile phone such as a smartphone, a tablet, and a head-mounted display. These mobiles terminals may also be called communication devices or electronic devices.

Figure 19:
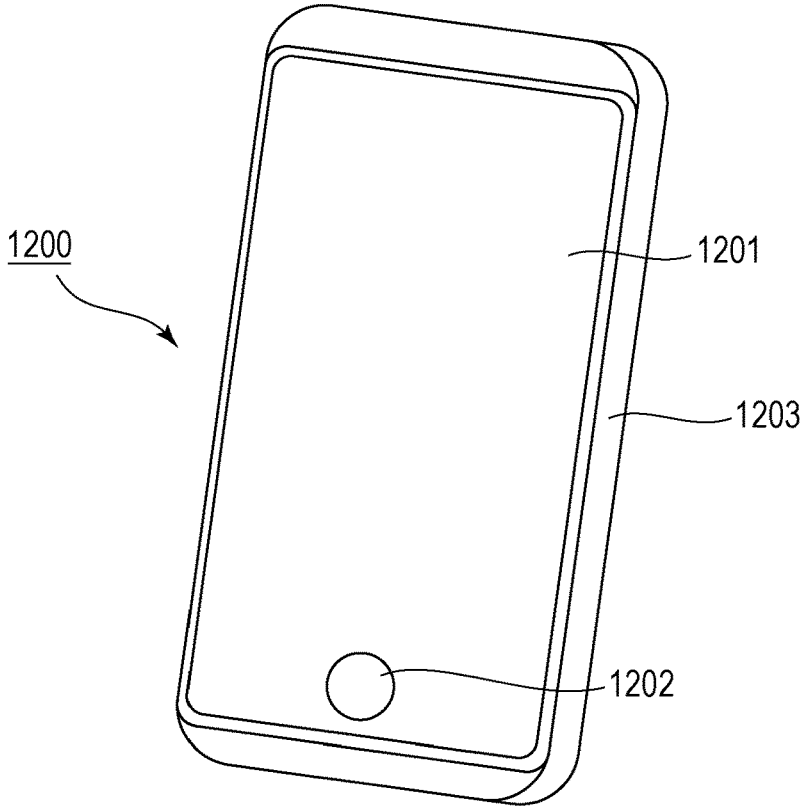
FIG. 19 illustrates a mobile device according to the third embodiment.

FIG. 19 is a schematic diagram of a mobile device according to the present embodiment. A mobile device 1200 includes a display unit 1201, an operation unit 1202, and a housing 1203. The housing 1203 may include a circuit, a printed circuit board including the circuit, a battery, and a communication unit. The operation unit 1202 may be a button or a touch-sensitive portion. The operation unit 1202 may be a biometric recognition unit that recognizes fingerprints for unlocking.

Figure 20A:
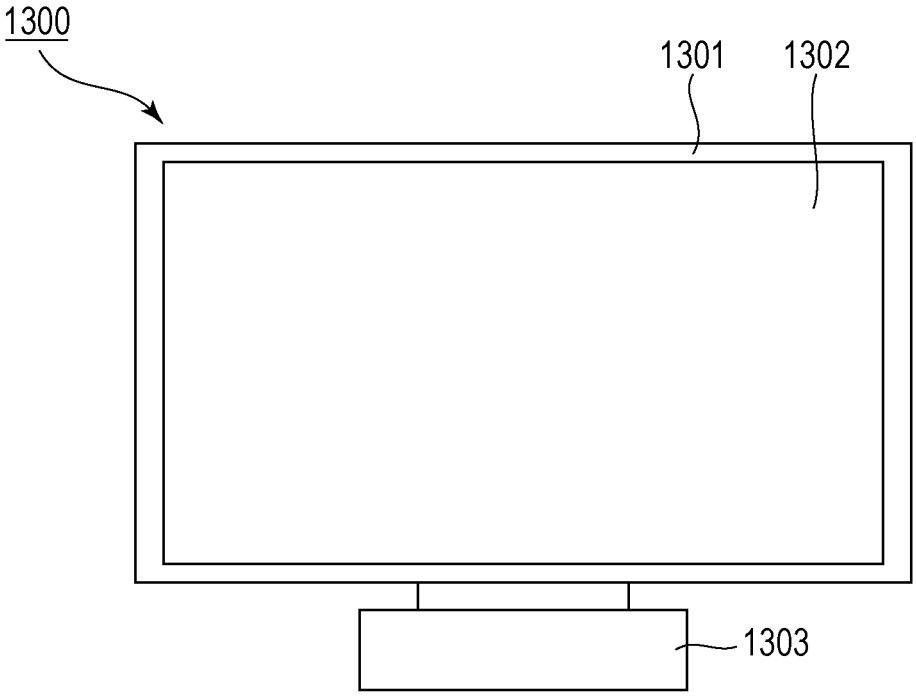
FIGS. 20A and 20B illustrate a display apparatus and a foldable display apparatus, respectively, according to the third embodiment.
Figure 20B:
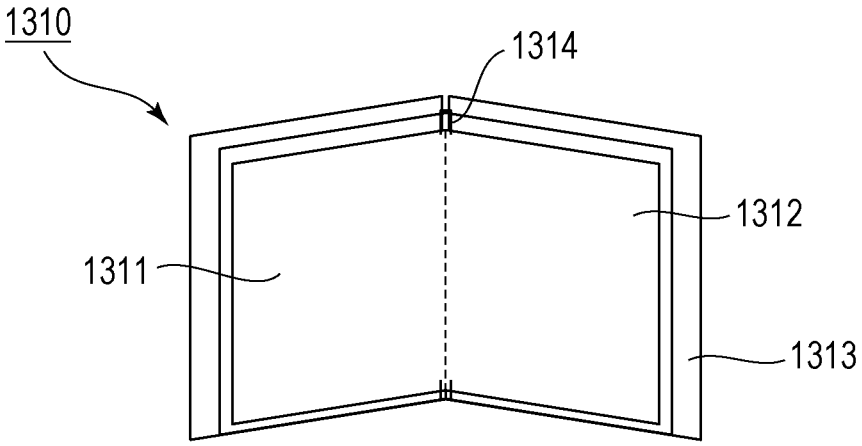

FIGS. 20A and 20B are schematic diagrams each illustrating a display apparatus according to the present embodiment. The display apparatus illustrated in FIG. 20A is, for example, a television monitor or a PC monitor. As illustrated, a display apparatus 1300 includes a frame 1301 and a display unit 1302. The display unit 1302 may include a light emitting element according to any of the embodiments described above.

The display apparatus 1300 further includes a base 1303 that supports the frame 1301 and the display unit 1302. The configuration of the base 1303 is not limited to that illustrated in FIG. 20A. A lower side of the frame 1301 may serve as a base.

The frame 1301 and the display unit 1302 may bend and their radius of curvature may range from 5000 mm to 6000 mm.

FIG. 20B is a schematic diagram illustrating another display apparatus according to the present embodiment. A display apparatus 1310 illustrated in FIG. 20B is a so-called foldable display apparatus configured to be foldable. The display apparatus 1310 includes a first display unit 1311, a second display unit 1312, a housing 1313, and a bend point 1314. The first display unit 1311 and the second display unit 1312 each may include a light emitting element according to any of the embodiments described above. The first display unit 1311 and the second display unit 1312 may combine to form a single seamless display apparatus. The first display unit 1311 and the second display unit 1312 may be split at the bend point 1314. The first display unit 1311 and the second display unit 1312 may each display a different image, or may display a single image together.

The aspect of the embodiment can reduce crosstalk between signal lines and reduce errors appearing in the displayed image.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A light emitting device comprising:

a plurality of digital-to-analog converters;

a scanning circuit configured to receive a digital signal input thereto and output the digital signal to each of the digital-to-analog converters; and a plurality of pixels arranged in a matrix and each configured to receive an analog signal from a corresponding one of the digital-to-analog converters, the analog signal being generated by digital-to-analog conversion of the digital signal performed by the digital-to-analog converter, wherein the scanning circuit includes a latch unit configured to hold the digital signal, a plurality of signal lines configured to transmit the digital signal from the latch unit to the digital-to-analog converters, and a shield line disposed between adjacent ones of the signal lines.

2. The light emitting device according to claim 1, wherein at least some of the signal lines are arranged in a wiring layer where the shield line is disposed.

3. The light emitting device according to claim 1, wherein the canning circuit includes a plurality of shield lines, and the plurality of shield lines and the plurality of signal lines are alternately arranged.

4. The light emitting device according to claim 3, wherein the plurality of shield lines is arranged in a wiring layer where the plurality of signal lines is disposed.

5. The light emitting device according to claim 1, wherein each of the signal lines transmits a signal for a bit different from another.

6. The light emitting device according to claim 1, wherein the light emitting device includes a plurality of selection lines each connected to a corresponding latch, respectively and configured to transmit a selection signal for selecting a latch to write data from among the plurality of latches, and wherein the shield line includes at least one of the selection signals.

7. The light emitting device according to claim 6, wherein the selection signals are arranged in a wiring layer where the plurality of signal lines is disposed.

8. The light emitting device according to claim 1, wherein some of the signal lines are arranged in a first layer and others of the signal lines are arranged in a second layer; and the shield line is disposed in a third layer between the first layer and the second layer.

9. The light emitting device according to claim 8, wherein a second shield line and a third shield line are disposed in both the first layer and the second layer, respectively.

10. A display apparatus comprising:

the emitting device according to claim 1; and a circuit board connected to the light emitting device.

11. An apparatus comprising:

an optical unit including a plurality of lenses;

an image pickup element configured to receive light passing through the optical unit; and a display unit configured to display an image, wherein the display unit displays an image picked up by the image pickup element, and includes the light emitting device according to claim 1.

12. The light emitting device according to claim 1, wherein the shield line is a wire configured to transmit a signal that changes in potential at times different from times when potentials in the signal lines change.

13. The light emitting device according to claim 1, wherein the latch unit includes a first latch array and a second latch array, the first latch array holds a digital signal input thereto and outputs the digital signal to the second latch array, the second latch array holds the digital signal input thereto from the first latch array and outputs the digital signal to the digital-to-analog converters, and during a period in which the second latch array outputs, to the digital-to-analog converters, the digital signal corresponding to the analog signal to be output to some of the pixels, the first latch array holds the digital signal corresponding to the analog signal to be output to others of the pixels.

14. A light emitting device comprising:

a plurality of digital-to-analog converters;

a scanning circuit configured to receive a digital signal input thereto and output the digital signal to each of the digital-to-analog converters; and a plurality of pixels arranged in a matrix and each configured to receive an analog signal from a corresponding one of the digital-to-analog converters, the analog signal being generated by digital-to-analog conversion of the digital signal performed by the digital-to-analog converter, wherein the scanning circuit includes a latch unit configured to hold the digital signal, a plurality of signal lines configured to transmit the digital signal from the latch unit to the digital-to-analog converters, and a shield line disposed between adjacent ones of the signal lines, and wherein the latch unit includes a first latch array and a second latch array, the first latch array holds a digital signal input thereto and outputs the digital signal to the second latch array, the second latch array holds the digital signal input thereto from the first latch array and outputs the digital signal to the digital-to-analog converters, and during a period in which the second latch array outputs, to the digital-to-analog converters, the digital signal corresponding to the analog signal to be output to some of the pixels, the first latch array holds the digital signal corresponding to the analog signal to be output to others of the pixels.

* * * * *